US010848864B2

(12) United States Patent
Lippert et al.

(10) Patent No.: US 10,848,864 B2
(45) Date of Patent: Nov. 24, 2020

(54) LIQUID-RESISTANT MODULES, ACOUSTIC TRANSDUCERS AND ELECTRONIC DEVICES

(71) Applicant: Apple Inc., Cupertino, CA (US)

(72) Inventors: Jesse A. Lippert, Sunnyvale, CA (US); Nikolas T. Vitt, Redwood City, CA (US); Shannon X. Yang, Sunnyvale, CA (US); William Lukens, San Francisco, CA (US); Trevor J. Ness, Santa Cruz, CA (US)

(73) Assignee: Apple Inc., Cupertino, CA (US)

( * ) Notice: Subject to any disclaimer, the term of this patent is extended or adjusted under 35 U.S.C. 154(b) by 178 days.

(21) Appl. No.: 16/125,532

(22) Filed: Sep. 7, 2018

(65) Prior Publication Data

US 2020/0084539 A1 Mar. 12, 2020

(51) Int. Cl.

| | |
|---|---|
| ***H04R 1/02*** | (2006.01) |
| ***H04R 1/44*** | (2006.01) |
| ***H04R 3/00*** | (2006.01) |
| ***H04R 1/08*** | (2006.01) |
| ***H04R 1/04*** | (2006.01) |

(52) U.S. Cl.

CPC ..... *H04R 1/44* (2013.01); *H04R 1/04* (2013.01); *H04R 1/086* (2013.01); *H04R 3/00* (2013.01)

(58) Field of Classification Search

CPC ..... H04R 1/02

See application file for complete search history.

(56) References Cited

U.S. PATENT DOCUMENTS

| | | | | |
|---|---|---|---|---|
| 5,812,496 | A * | 9/1998 | Peck | H04R 1/44 367/168 |
| 10,587,942 | B1 * | 3/2020 | Minervini | B81B 7/0038 |
| 2002/0181725 | A1 * | 12/2002 | Johannsen | H04R 19/005 381/174 |
| 2005/0254673 | A1 * | 11/2005 | Hsieh | B81C 1/00158 381/175 |
| 2013/0044906 | A1 * | 2/2013 | Lee | H04R 19/013 381/191 |
| 2015/0010191 | A1 * | 1/2015 | Baumhauer, Jr. | H04R 19/005 381/355 |
| 2015/0245146 | A1 * | 8/2015 | Liu | H04R 17/02 257/416 |
| 2016/0112807 | A1 * | 4/2016 | Yuan | B81C 1/00571 381/174 |
| 2017/0048625 | A1 * | 2/2017 | Salmon | B81C 1/00309 |

(Continued)

*Primary Examiner* — Olisa Anwah

(74) *Attorney, Agent, or Firm* — Ganz Pollard, LLC

(57) ABSTRACT

A liquid-resistant module can be formed as a laminated construct having a housing, a cap, and a port membrane to inhibit liquid from passing across the membrane. The housing defines an internal duct extending from an inlet port to an outlet region. The cap defines an acoustic port and extends across the outlet region of the housing. The port membrane is attached to the cap and extends across the acoustic passage. The port membrane inhibits passage of liquid water through the membrane at differential pressures across the membrane less than a threshold pressure differential, and yet is gas permeable. The module can provide a liquid-resistant seal with an enclosure of an electronic device, and an enclosed microphone transducer or an enclosed loudspeaker transducer can be attached to the cap such that a port opening to or from the transducer is aligned with the acoustic port.

20 Claims, 4 Drawing Sheets

(56) References Cited

U.S. PATENT DOCUMENTS

| | | | | |
|---|---|---|---|---|
| 2018/0063634 | A1 | 3/2018 | Dave et al. | |
| 2019/0077654 | A1* | 3/2019 | Reagan | H04R 19/04 |
| 2019/0084828 | A1* | 3/2019 | Albers | H04R 19/04 |
| 2020/0039816 | A1* | 2/2020 | Zou | B81B 7/0061 |
| 2020/0053458 | A1* | 2/2020 | Ring | H04R 3/007 |

* cited by examiner

LIQUID-RESISTANT MODULES, ACOUSTIC TRANSDUCERS AND ELECTRONIC DEVICES

FIELD

This application and related subject matter (collectively referred to as the "disclosure") generally concern liquid-resistant electronic devices, electro-acoustic transducers, and modules, as well as related systems.

BACKGROUND INFORMATION

In general, sound (sometimes also referred to as an acoustic signal) constitutes a vibration that propagates through a carrier medium, such as, for example, a gas, a liquid, or a solid. An electro-acoustic transducer, in turn, is a device configured to convert an incoming acoustic signal to an electrical signal, or vice-versa. Thus, an acoustic transducer in the form of a loudspeaker can convert an incoming signal (e.g., an electrical signal) to an emitted acoustic signal, while an acoustic transducer in the form of a microphone can be configured to convert an incoming acoustic signal to an electrical (or other) signal.

Some electronic devices that incorporate electro-acoustic transducers may be exposed to environments other than dry air, such as, for example, rain, or may be fully immersed in a liquid. As an example, users of some electronic devices may wish to fully immerse their electronic device in water during certain activities (e.g., when participating in a water sport, like swimming, surfing, rafting, wake boarding, etc.) Nonetheless, intrusion of water or another liquid into an electronic device can damage components in the device, including electro-acoustic transducers.

SUMMARY

Concepts, systems, methods, and apparatus disclosed herein overcome many problems in the prior art and address one or more of the aforementioned or other needs. For example, this application describes a variety of liquid-resistant modules suitable to inhibit intrusion of water or other liquids past a selected boundary. Such modules can be combined with each other and into an electronic device to inhibit intrusion of water into the electronic device, making the electronic device liquid resistant. As well, some disclosed modules are compatible with liquid-resistance tests prior to final assembly with a liquid-sensitive component (e.g., a microphone transducer). By allowing testing prior to final assembly, yields of liquid-resistant modules (e.g., microphone modules) can be increased at final assembly.

According to a first aspect, liquid-resistant port modules are disclosed. Such a port module has a housing defining an acoustic channel. The housing extends from a first end to an opposed second end. Each end has a corresponding aperture open to the channel. Port modules have a cap defining a gas-permeable region and spanning the aperture corresponding to the first end of the housing. The gas-permeable region of the cap defines an acoustic pathway through the cap. A liquid-resistant port membrane is positioned between the channel and the gas-permeable region of the cap. The port membrane is gas permeable. In an embodiment, the port membrane is acoustically transparent.

The port membrane can prevent movement of water across the port membrane for hydrostatic pressure gradients across the port membrane below a selected threshold hydrostatic pressure gradient. The port membrane can be formed of one or more of PTFE and ePTFE.

A protective barrier can span across the channel at a position between the port membrane and the second end of the housing.

In some embodiments, the housing defines an interior surface facing the channel and an exterior surface opposite the interior surface. The exterior surface can define a recess extending around the housing at a position adjacent the second end of the housing. A gasket can be seated in the recess.

An embodiment of the housing can define an abutment positioned adjacent the first end of the channel. An adhesive can be positioned between the cap and the abutment and can affix the cap to the abutment.

The adhesive can be a first adhesive, and the port module can have a second adhesive positioned between the gas-permeable membrane and the cap. The second adhesive can affix the gas-permeable membrane to the cap. The second adhesive can define an aperture positioned between the gas-permeable membrane and the gas-permeable region of the cap.

An embodiment of the housing defines a floor recessed from the first end of the channel. An abutment can extend around a periphery of the floor and define the aperture corresponding to the first end of the housing. The cap can be adhesively coupled with the abutment. A liquid-impermeable gasket member can be positioned in compression between the port membrane and the floor. The floor can also define an aperture open to the channel, and the gasket member can define an aperture extending from the floor to a region of the port membrane overlying the gas-permeable region of the stiffener.

According to a second aspect, microphone assemblies are described. A microphone module can define a first acoustic port and a periphery extending around the first acoustic port. A liquid-resistant port module can have a duct extending from a first end to a second end, and can define a liquid-resistant port adjacent the first end of the duct. The liquid-resistant port can be positioned opposite the first acoustic port. The periphery of the microphone module can be, e.g., adhesively coupled with a corresponding region of the port module. Other modes of coupling also are possible, including, by way of example only, ultrasonic welding and gasketed snap-fit couplings, as well as reversible couplings. The second end of the duct can define a second acoustic port positioned distally of the first end relative to the microphone module.

The port module can also have a mesh spanning across the duct at a position between the first end and the second end of the duct. The mesh may prevent intrusion of debris and protect inner components from damage. The mesh also, or alternatively, provide a selected measure of acoustic damping. Such selected damping can permit an acoustic response of the port module to be tuned.

An embodiment of the microphone module can have a packaged microphone transducer with an exposed sensitive region. The microphone module can also include an electrical substrate having a plurality of electrical conductors and defining a first major surface, an opposed second major surface, and an aperture extending through the electrical substrate from the first major surface to the second major surface. The packaged microphone transducer can be electrically coupled with the plurality of electrical conductors and the aperture through the electrical substrate can open to the sensitive region of the packaged microphone transducer.

The microphone module can also include a stiffener substrate defining a first major surface, an opposed second major surface, and an aperture extending through the stiffener from the first major surface to the second major surface. The aperture through the stiffener substrate can be positioned opposite the aperture through the electrical substrate.

In an embodiment, the microphone module and the port module can couple with each other such that the sensitive region of the microphone transducer is positioned opposite the liquid-resistant port of the port module relative to the electrical substrate and the stiffener substrate.

The microphone module and the port module can be coupled with each other such that the liquid-resistant port of the port module and the sensitive region of the microphone transducer are acoustically coupled with each other.

In an embodiment, the port module includes a plate spanning across the duct and defining a port region. The embodiment of the port module also includes a liquid-resistant port membrane spanning across the port region and sealably affixed with the plate. A housing adhesively couples with the plate at a region outward of the port membrane. The housing can define the second end of the port module and can extend distally from a proximal end positioned adjacent the plate to the second end of the port module.

In an embodiment, the proximal end of the housing defines a recessed floor surrounded by a peripheral wall extending proximally of the floor. The peripheral wall and the plate can be adhesively coupled with each other, and the port membrane can be positioned laterally inwardly of the peripheral wall.

In an embodiment, the port membrane defines a peripheral region positioned laterally outwardly of the perforated region of the plate. The microphone assembly can also have a gasket compressed between the peripheral region of the port membrane and the recessed floor.

According to a third aspect, liquid-resistant electronic devices are described. A liquid-resistant electronic device can include a packaged microphone transducer defining a sensitive transducer region and a microphone port opening to the sensitive transducer region. A plate defines a first major surface and an opposed second major surface. A perforation extends through the plate from the first major surface to the second major surface, and the packaged microphone transducer is coupled with the first major surface of the plate such that the perforation and the microphone port are acoustically aligned with each other. A gas-permeable membrane is coupled with the second major surface of the plate and spans the perforation at position opposite the microphone port. A housing is adhesively coupled with the second major surface of the plate at a position outward of the gas-permeable membrane relative to the perforation, such that a compressive load path between the plate and the housing is substantially independent of a compressive load path between the plate and the gas-permeable membrane.

In an embodiment, the channel housing defines a channel extending transversely relative to the second major surface of the plate.

In an embodiment, the gas-permeable membrane is liquid resistant.

The foregoing and other features and advantages will become more apparent from the following detailed description, which proceeds with reference to the accompanying drawings.

BRIEF DESCRIPTION OF THE DRAWINGS

Referring to the drawings, wherein like numerals refer to like parts throughout the several views and this specification, aspects of presently disclosed principles are illustrated by way of example, and not by way of limitation.

DETAILED DESCRIPTION

The following describes various principles related to liquid-resistant electronic devices, electro-acoustic transducers, and modules, as well as related systems. For example, some disclosed principles pertain to systems, methods, and components that permit passage of acoustic energy in an acoustically transparent manner while concurrently inhibiting intrusion of a liquid beyond a selected boundary. As but one illustrative example, liquid-resistant microphone assemblies are described. That said, descriptions herein of specific appliance, apparatus or system configurations, and specific combinations of method acts, are but particular examples of contemplated appliance, apparatus or system configurations, and method combinations, chosen as being convenient illustrative examples of disclosed principles. One or more of the disclosed principles can be incorporated in various other appliance, apparatus or system configurations, and method combinations, to achieve any of a variety of corresponding, desired characteristics. Thus, a person of ordinary skill in the art, following a review of this disclosure, will appreciate that combinations having attributes that are different from those specific examples discussed herein can embody one or more presently disclosed principles, and can be used in applications not described herein in detail. Such alternative embodiments also fall within the scope of this disclosure.

I. Liquid-Resistant Port Modules

Figure 1:
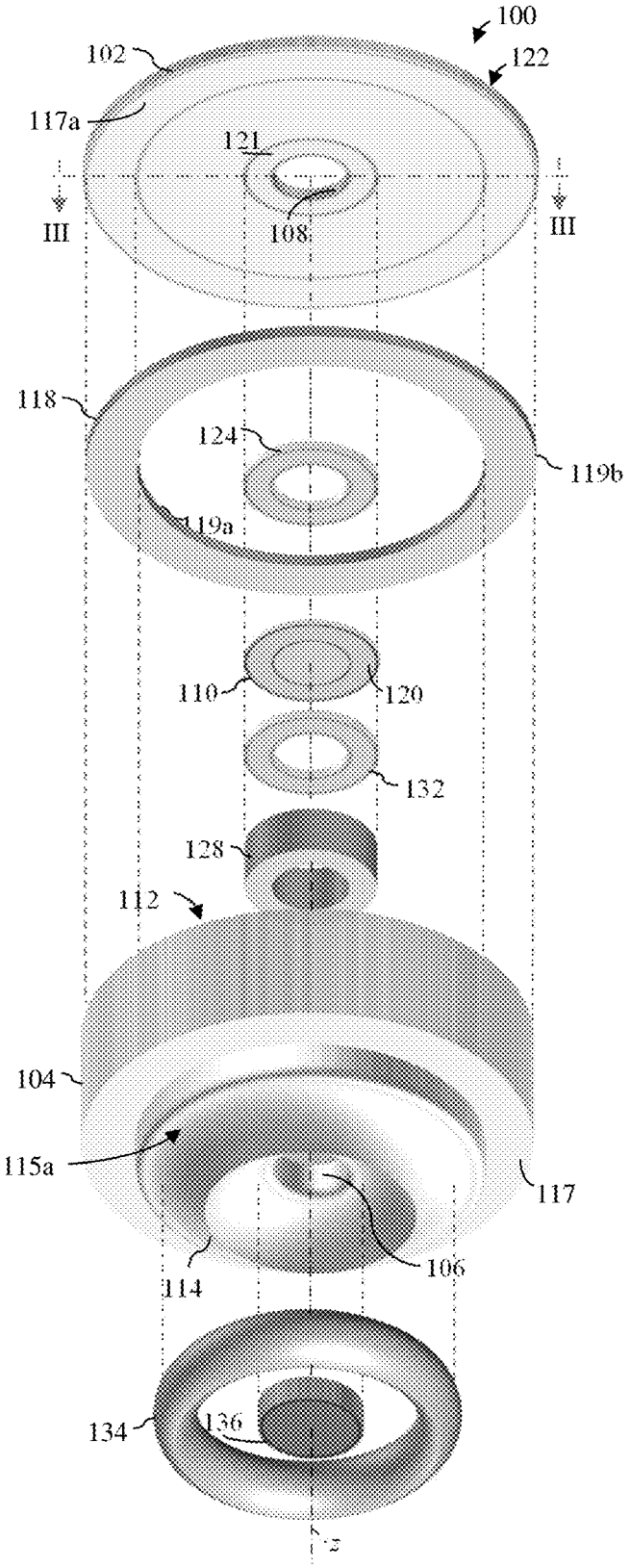
FIG. 1 illustrates an exploded view of a liquid-resistant port module.
Figure 3:
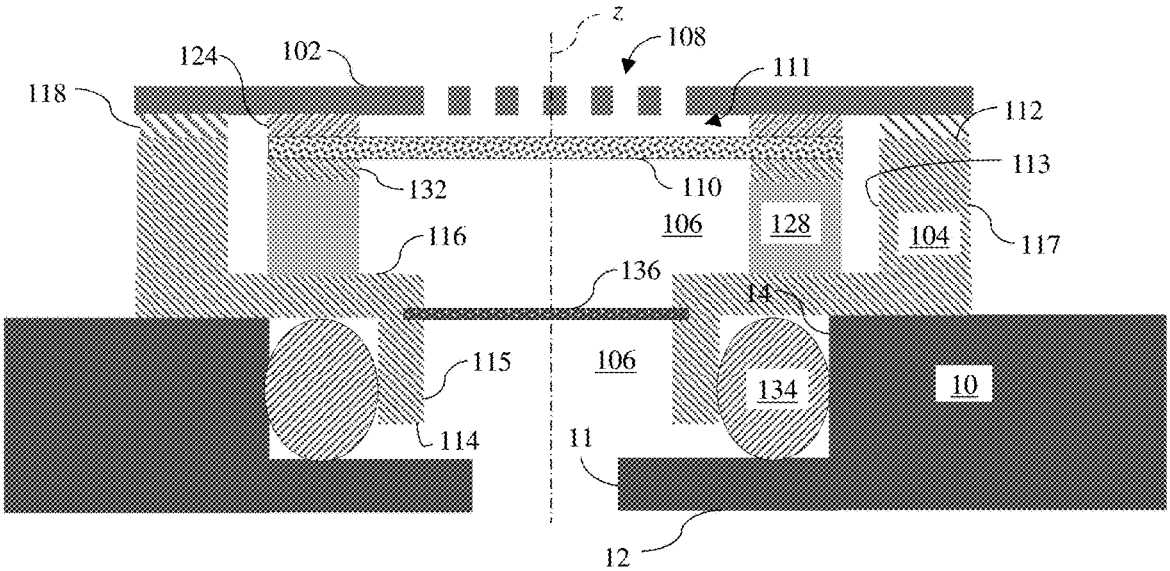
FIG. 3 illustrates a cross-sectional view of a liquid-resistant port module as in FIG. 1 sealingly engaged with a chassis of an electronic device. The cross-sectional view is taken along section line III-III in FIG. 1.

Referring now to FIGS. 1 and 3, a liquid-resistant port module 100 is shown in exploded view. The port module 100 has a cap 102 and a housing 104 defining an acoustic channel 106. The cap 102 is mounted to the housing 104 and defines a gas-permeable region 108 acoustically coupled with the acoustic channel. The gas-permeable region 108 of the cap 102 can be substantially acoustically transparent and yet inhibit transport of a liquid across the gas-permeable region. In one working embodiment, the gas permeable region 108 defines an acoustic port and an acoustically transparent, liquid-resistant port membrane 110 can span across the acoustic port. Thus, a port module 100 can have a liquid-resistant acoustic port from an acoustic channel.

For example, the illustrated housing 104 extends from a first end 112 to an opposed second end 114. The acoustic channel 106 extends between the first end 112 of the housing and the second end 114 of the housing. As well, each end 112, 114 has a corresponding aperture 113, 115 open to the channel 106. A longitudinal recess (along the z-axis) from the first end 112 of the housing 104 can define a floor 116 and a wall 117 extending around a periphery of the floor. The recess from the first end 112 can define the aperture 113 corresponding to the first end of the housing. The housing 104 can be liquid-impermeable, e.g., formed from injection-molded plastic.

In FIGS. 1 and 3, the cap 102 spans across the aperture 113 corresponding to the first end 112 of the housing and defines the gas-permeable region 109. The gas-permeable region 109 provides an acoustic pathway through the plate without requiring the plate to acoustically vibrate to transmit sound from one side of the plate to an opposite side of the plate. A terminal surface of the wall 117 corresponding to the first end 112 of the housing 104 can define an abutment, and the cap 102 can be adhesively coupled with the abutment. For example, a heat-activated film (HAF) or other adhesive 118 can be positioned between the cap 102 and the abutment, and the HAF can affix the cap to the abutment (indicated by the annular region 117*a* on the cap in FIG. 1). As shown by way of the annular adhesive 118 in FIG. 1, the adhesive layer can have an inner periphery 119*a* and an outer periphery 119*b* that correspond to a shape of the abutment wall 117 so as not to obstruct the aperture 113 at the first end 112 of the housing 104 or the acoustic channel 106.

According to another aspect, the cap can be coupled with the housing using a reversible coupling (e.g., a fastener) or a permanent coupling (e.g., a weld, such as, for example, a laser weld).

The cap 102 can be formed from a metal or other stiff material suitable to support the laminated port membrane 110 without deflecting or resonating when exposed to selected levels of acoustic input. The gas-permeable region 108 of the cap 012 can constitute a single aperture extending through the cap or a plurality of apertures that, taken together, define a gas-permeable, acoustic port 108 through the cap 102.

As noted above, the gas-permeable region 108 of the cap 102 can span across at least a portion of the aperture 113 corresponding to the first end 112 of the housing 104. The liquid-resistant port membrane 110 can be positioned between the channel 106 and the gas-permeable region 108 of the cap 102. The port membrane 110 also can be gas permeable, as to be "acoustically transparent," e.g., by transmitting acoustic pressure waves across the port membrane with limited damping. As used herein, "acoustically transparent" means having an acoustic impedance less than about 45 MKS Rayls, such as, for example, between about 25 MKS Rayls and about 35 MKS Rayls. As well, some membranes prevent movement of water across the port membrane 110 when a hydrostatic pressure gradient across the port membrane falls below a selected threshold hydrostatic pressure gradient. Nonetheless, a port membrane 110 need not be acoustically transparent, particularly when other competing design priorities are addressed. For example, about 3.5 dB loss in sound power may be acceptable for some embodiments, e.g., embodiments expected to be exposed to relatively high (e.g., between 2 bar and 5 bar) hydrostatic pressure gradients.

In general, a suitable port membrane for a particular application can permit a flow of gas therethrough while being impermeable to a liquid at liquid breakthrough pressures below a selected threshold pressure. For example, pores in the port membrane 110 can measure between about 0.1 μm and about 10 μm, making the port membrane gas permeable while inhibiting liquid movement across the membrane.

A representative example of a port membrane 110 can be formed of PTFE or ePTFE, though other suitable materials can be used in place of or in addition to PTFE or ePTFE. Such materials include, for example, polymerized fibers (e.g., polyvinylidene fluoride, or polyvinylidene difluoride, both of which generally are referred to in the art as "PVDF" and are inert thermoplastic fluoropolymers produced by the polymerization of vinylidene difluoride).

As used herein, the term "PTFE" means polytetrafluoroethylene. PTFE, commonly referred to by the DuPont trademark Teflon® or the ICI trademark Fluon®, is well known for its chemical resistance, thermal stability, and hydrophobicity. Expanded PTFE, sometimes also referred to as ePTFE, has a porous structure defined by a web of interconnected fibrils. ePTFE commonly has a porosity of about 85% by volume, but because of its hydrophobicity, has a relatively high liquid breakthrough pressure (i.e., a threshold hydrostatic pressure below which the ePTFE remains impermeable to the liquid) for a variety of liquids, including water.

Other port-membrane embodiments can have a composite or a laminate construction. For example, plural layers of material can be laminated together. In one example, a woven or knit material can be laminated to ePTFE or PTFE to add tensile and/or shear strength to the membrane. In other embodiments, a composite port membrane can be formed by forming ePTFE (or other material) around a lattice structure (e.g., a knit or woven sheet material, like a fabric or screen, formed of any of a variety of materials). In some port-membrane embodiments, a coating or a treatment can be applied to enhance oleophobicity of the membrane.

A peripheral region 120 of the port membrane 110 can be adhesively secured to a major surface of the cap 102 facing the acoustic channel 106 at a position (indicated by the annulus 121 in FIG. 1) outward of an outer periphery 120 of the gas-permeable region 108 and inward of the housing abutment 117, 117*a*. The port membrane 110 is attached to a major surface of the cap 102 facing the acoustic channel at a region independent of the region 117*a* of attachment between the cap 102 and the housing 104. Such independent attachment regions can maintain a structural integrity of the port membrane 110. For example, the port membrane can remain planar and without buckling under eccentric loading that can occur in embodiments that place a periphery of the port membrane in the laminated stack-up between the cap 102 and the housing wall 117. As well, an increase in barometric or hydraulic pressure within the acoustic channel 106 can deform the port membrane 110. Under sufficient deformations of the port membrane 110, the port membrane can come into contact with and urge against the perforated region 108 of the cap 102. A distance along the z-axis between the cap 102 and the port membrane 110 can be selected to ensure the material of the port membrane 110 remains within an elastic-deformation regime within its range of deformations (e.g., until the membrane 110 urges against and is supported by the cap 102). Larger distances may allow a plastic deformation of the port membrane, permanently deforming the membrane and degrading acoustic performance, gas-permeability, or both. Nonetheless, the port membrane 110 can alternatively be attached to and supported by a major surface 122 of the cap 102 on a side opposite the major surface facing the channel 106.

Some disclosed caps 102 can include one or more features arranged to place or to maintain the port membrane 110 in tension. For example, one or more port-membrane anchors (not shown) can be positioned outward of the perforated region 108 of the cap 102 and inhibit, e.g., radial contraction of the port membrane.

In any event, the region of attachment 121 between the port membrane 110 and the cap 102 can define a liquid-impermeable or at least a liquid-resistant adhesive bond. Thus, independently attaching the port membrane 110 to the cap 102 can permit hydraulic leak testing of the cap-and-membrane assembly prior to assembling the cap to the housing 104. A suitable adhesive bond can be formed using a double-coated adhesive tape 124 formed with an acrylic adhesive on opposed major surfaces of a polyester carrier. In one example, the adhesive tape can measure about 0.03 mm thick.

A thickness of the adhesive tape 124 can be selected to space the port membrane 110 from a surface of the cap 102. A separation gap 111 can reduce a likelihood that the port membrane 110 may impact the gas-permeable region 108 of the cap 102 when exposed to a threshold level of acoustic energy across a selected frequency band. For example, the port membrane 110 may tend to resonate when exposed to a selected frequency of acoustic energy, yet selecting an adhesive of a thickness greater than a likely amplitude of the membrane's vibration can prevent the port membrane 110 from impacting (e.g., slapping against) the acoustic port 108 through the cap 102. Eliminating such a vibratory contact between the membrane 110 and the cap 102 may be desirable, as such vibratory contact may impair an acoustic signal passing through the port module 100. Nonetheless, when exposed to hydraulic pressure, the membrane 110 can deform and be supported by the cap 102. According to one aspect, the gap 111 is sized to permit elastic deformation of the membrane and to prevent plastic deformation of the membrane.

Returning now to the structure of the housing 104, the floor 116 (FIG. 3) can define an aperture 126 open to the acoustic channel 106, acoustically coupling the acoustic channel 106 with the port membrane 110 and the gas-permeable region 108 of the cap 102.

To enhance liquid-resistance of the port module 100, a gasket member 128 can be positioned in compression between the cap 102 and the floor 116. As well, the gasket member 128 can urge against the cap 102 at a position between an outer periphery of the port membrane 110 and the abutment defined by the wall 117 of the housing. In other aspects, the gasket-member urges against the outer periphery 120 of the port membrane 110, as to enhance adhesive bonding between the membrane and the cap.

In either configuration, the gasket member 128 tends to urge the cap 102 away from the housing 104. Accordingly, the coupling between the cap 102 and the housing 104 desirably resists such a delamination load arising from the compressive load applied to the gasket by the cap and housing. A gasket material can be selected to provide a suitable measure of resiliency to balance the competing goals of compressing a periphery of the port membrane 110 while avoiding delamination of the cap 102 from the housing 104.

The compressive load applied to the gasket member may vary from port module to port module based on, for example, manufacturing variances in height along the z-axis. For example, variation in a thickness of the HAF used to adhere the cap 102 to the housing 104 may arise.

The gasket member 128 defines an aperture 130 (FIG. 3) extending from, e.g., the aperture through the floor 126 to a region of the port membrane 110 overlying the gas-permeable region 108 of the cap 102. A port module 100 as shown in FIG. 1 can be hydraulically tested for leaks prior to being assembled with a microphone module as described below. The gasket member 128 can be liquid permeable or liquid impermeable. A liquid-permeable gasket member 128 can allow liquid to pass therethrough and contact the wall 117 defining the surface 112. Accordingly, during a high-pressure (e.g., hydraulic) leak test, integrity of the coupling between the plate 102 and the housing 104 can be assessed.

A double-coated adhesive tape 132 can be positioned between the gasket member 128 and the port membrane 110 (as in FIGS. 1 and 3) or the cap 102 (not shown). The gasket 128 can urge against the floor 116 of the housing 104 to form a liquid-resistant seal with the housing 104. Each of the double-coated adhesive tapes 124, 132 can define a corresponding aperture aligned with the acoustic channel 106 through the housing 104 and the acoustic port 108 through the cap 102.

As shown in FIG. 1, the housing 104 can define an interior surface 115 facing the acoustic channel 106 and an exterior surface 115*a* in opposed relationship to the interior surface. The exterior surface 115*a* can define a recess extending around the outer periphery (e.g., circumferentially around) the housing 104. For example, the recess can extend around the exterior surface at a position adjacent the second end 114 of the housing 104.

The recess can define a seat for a gasket 134, e.g., an O-ring. For example, the cross-sectional view in FIG. 3 shows a gasket 134 seated in the recess and positioned in compression between the exterior surface 115*a* of the housing 104 and a chassis 10 of an electronic device. As FIG. 3 also shows, the chassis 10 can define an aperture or other acoustic port 11 opening from an external surface 12 of the electronic device. The acoustic port 11 is aligned with or otherwise acoustically coupled with the acoustic channel 106 of the housing 104.

A protective barrier 136 can span across the channel 106 at a position between the port membrane 110 and the second end 114 of the housing 104. The protective barrier can be porous, as to permit gas-movement across the barrier and yet inhibit particulate matter or other debris from intruding into the acoustic channel 106. In one aspect, the protective barrier 136 can be a polyester-based acoustic mesh being acoustically transparent or having a selected measure of damping.

II. Liquid Resistant Microphone Modules

Figure 2:
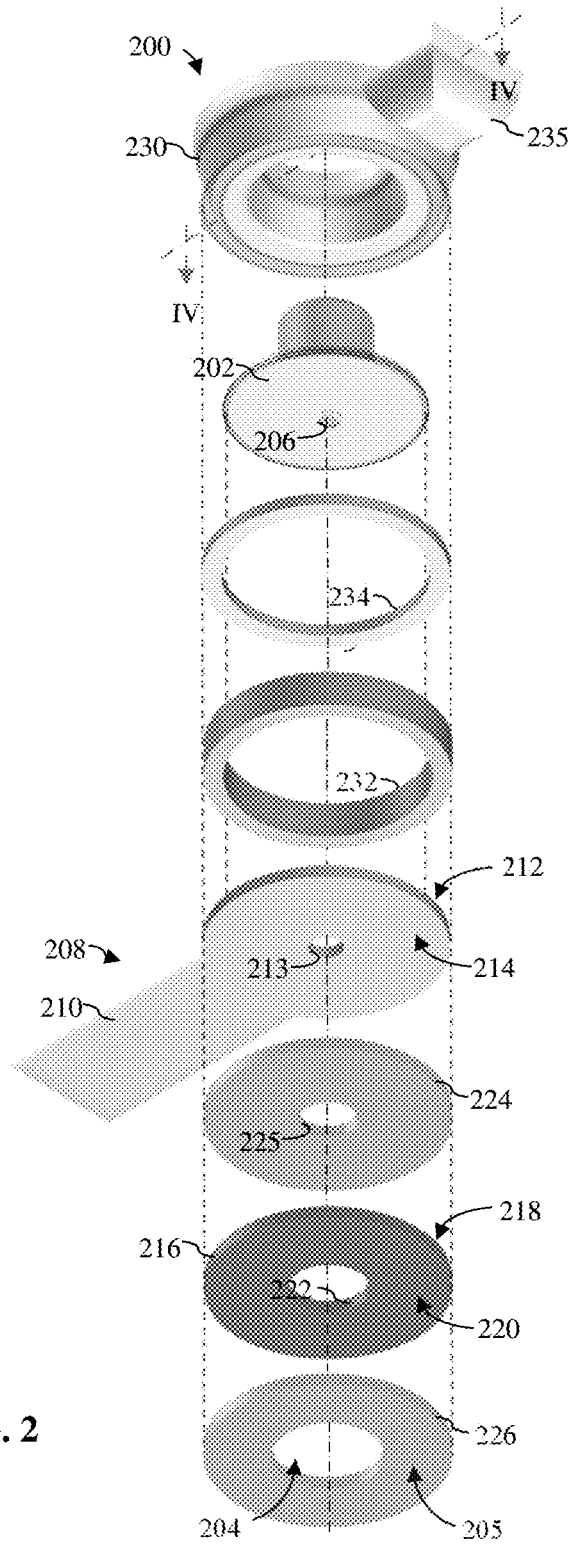
FIG. 2 illustrates an exploded view of a microphone module that can be combined with the port module shown in FIG. 1.
Figure 4:
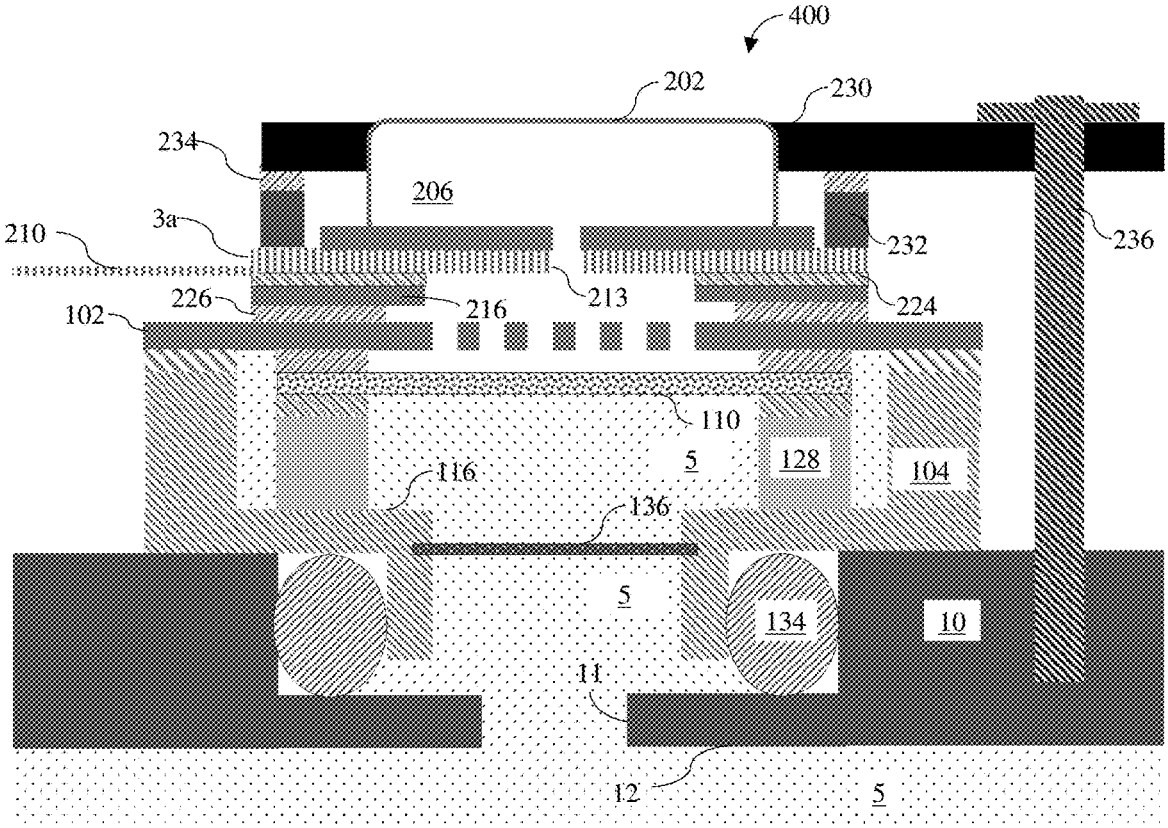
FIG. 4 illustrates a cross-sectional view of a microphone module as in FIG. 2 assembled with the liquid-resistant port module depicted in FIG. 3. The cross-sectional view of the microphone module is taken along section line IV-IV in FIG. 1.
Figure 5:
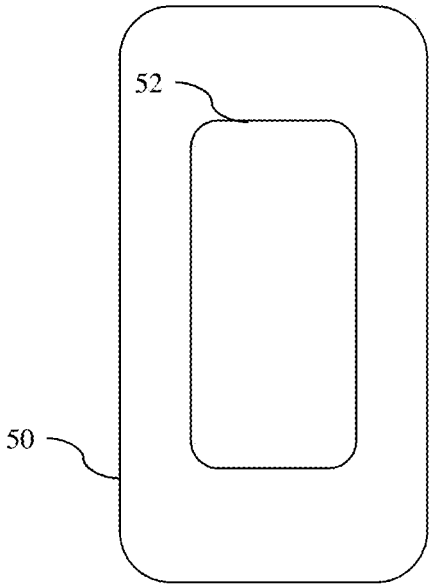
FIG. 5 shows a plan elevation view from above another port module of the type shown in FIGS. 1 and 3.
Figure 6:
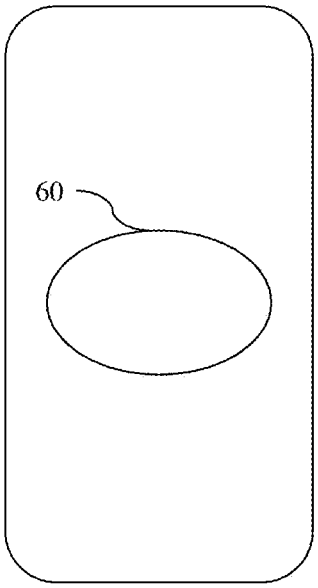
FIG. 6 shows a plan elevation view from below the port module shown in FIG. 5.
Figure 7:
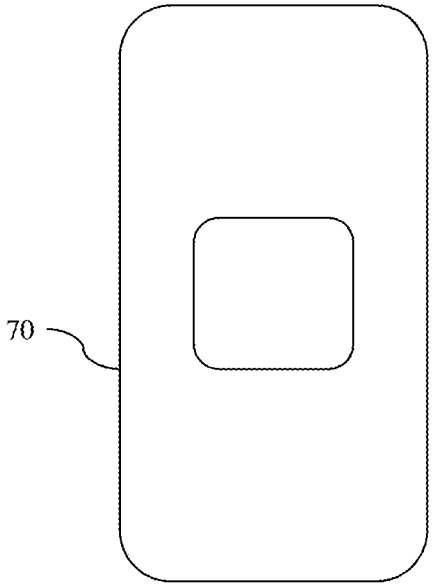
FIG. 7 shows a plan elevation view from above another port module.
Figure 8:
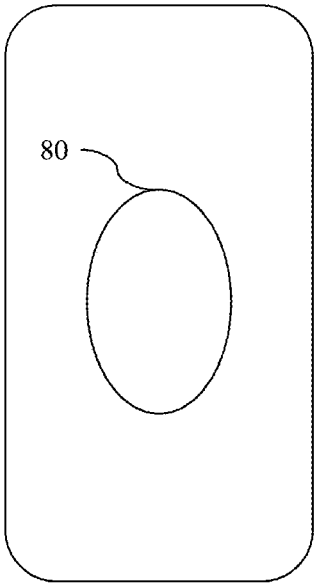
FIG. 8 shows a plan elevation view from below the port module shown in FIG. 7.

Referring now to FIGS. 2 and 4, a laminated microphone module 200 will be described. The microphone module has a microphone transducer 202 and defines an acoustic port 204 extending axially through a laminated stack of components in alignment with the acoustic port 206 of the microphone transducer. A periphery 205 extends around the acoustic port 204.

The microphone module 200 can be adhesively coupled with a corresponding region of a liquid-resistant port module 100 of the type described above in relation to FIGS. 1 and 3. For example, the acoustic port 204 of the microphone module 200 can be acoustically coupled with the liquid-resistant acoustic port 108. The adhesive coupling between the port module 100 and the microphone module 200 can be liquid-resistant, as to inhibit penetration of water or another liquid into the acoustic port.

The microphone module 200 can include a packaged microphone transducer 202 having an exposed sensitive region 206. The microphone transducer 202 may be, for example, a micro-electro-mechanical system (MEMS) microphone. It is contemplated, however, that microphone transducer can be any type of electro-acoustic transducer operable to convert sound into an electrical output signal, such as, for example, a piezoelectric microphone, a dynamic microphone or an electret microphone.

The microphone transducer 202 can be electrically coupled with an electrical substrate 208. In general, the electrical substrate 208 can include a plurality of electrical conductors. In some instances, the electrical substrate 208 can be a laminated substrate having one or more layers of electrical conductors juxtaposed with alternating layers of dielectric or electrically insulative material.

Some electrical substrates are flexible, e.g., pliable or bendable within certain limits without damage to the electrical conductors or delamination of the juxtaposed layers. The electrical conductors of a flexible circuit board may be formed of an alloy of copper, and the intervening layers separating conductive layers may be formed, for example, from polyimide or another suitable material. Such a flexible circuit board is sometimes referred to in the art as "flex circuit" or "flex." As well, the flex can be perforated or otherwise define one or more through-hole apertures sized to permit an acoustic signal to pass therethrough in an acoustically transparent manner, or with a selected measure of damping.

In addition to the microphone transducer, the electrical substrate 208 can be operatively coupled with one or more components. For example, the electrical substrate can have a region 210 extending away from the microphone transducer 202 in one or more directions, and the electrical conductors to which the microphone transducer 202 is electrically coupled can also extend away from the microphone transducer to electrically couple with another component (not shown). Such a component can include a sensor of various types, and/or other functional and/or computational attributes.

The electrical substrate 208 can define a first major surface 212, an opposed second major surface 214, and an aperture 213 extending through the electrical substrate from the first major surface to the second major surface. The packaged microphone transducer 202 can be electrically coupled with the plurality of electrical conductors and mounted to the first major surface 212. The aperture 213 through the electrical substrate can open to the sensitive region 206 of the packaged microphone transducer 202.

A stiffener substrate 216 or other supporting member can be coupled with the electrical substrate. For example, such a stiffener substrate 216 can be adhesively laminated with the electrical substrate 208 so as to stiffen the electrical substrate around the peripheral region of the microphone transducer. Such stiffening may be desirable to maintain or improve a long-term reliability of an electrical interconnection between the microphone transducer and electrical conductors in the electrical substrate.

The illustrated stiffener substrate 216 defines a first major surface 218 and an opposed second major surface 220. An aperture 222 extends through the stiffener substrate 216 from the first major surface to the second major surface. The aperture 222 through the stiffener substrate 216 can be positioned opposite the aperture 213 through the electrical substrate 208.

A layer of adhesive tape 224 can secure the electrical substrate 208 to the stiffener 216. The adhesive may be electrically conductive and the thermally curable. The adhesive layer 224 defines an aperture 225 acoustically coupling the aperture 213 in the electrical substrate with the aperture 222 in the stiffener 216.

A pressure-sensitive adhesive (PSA) 226 can join the microphone module 200 with the port module 100. For example, the pressure-sensitive adhesive 226 can retain the second major surface 220 of the stiffener 216 with an opposed major surface defined by the cap 102. Such an arrangement can ensure that the liquid-resistant port 108 of the port module 102 and the sensitive region of the microphone transducer 202 are acoustically coupled with each other. One or both of the adhesive layers 224 and 226 can be electrically conductive, as to ground the microphone transducer (e.g., to inhibit electromagnetic interference of the microphone to other components, e.g., an antenna), to inhibit galvanic action between dissimilar materials, or both.

The apertures extending through each successive layer of material between the microphone transducer 202 and the liquid-resistant acoustic port 108 through the cap 102 can be successively larger than (or smaller than, or equal in size to) the aperture through the immediately preceding layer. Selectively sizing the apertures through each layer can aid in tuning an acoustic response of the acoustic channel between the external port 11 and a port opening to the sensitive region 206 of the microphone transducer 202.

III. Liquid-Resistant Electronic Devices

As also shown in FIG. 2, a mounting bracket 230 can secure an assembly of a port module 100 with a microphone module 200, as just described, in a liquid-resistant electronic device. For example, referring still to FIGS. 2 and 4, an electronic device can have a chassis having a chassis wall 10. The chassis wall 10 can define a recessed region 14 complementarily configured relative to an external surface 115*a* of the port module 100 and can sealingly receive the duct housing 104. An O-ring or other gasket 134 can urge between the outer surface 115*a* of the duct housing 104 and a corresponding seat defined by the recess 14 in the chassis wall 10 to define a liquid-resistant, sealing engagement between the port module 100 and the chassis of the electronic device.

A mounting bracket 230 can overlie and retain the microphone assembly in compression between the bracket and the chassis wall 10. For example, the bracket 230 can be complementarily configured relative to a contour of the microphone assembly and can receive a corresponding portion of the microphone module 200 in a secure registration. For example, a compliant (e.g., silicone) member 232 can be positioned in compression between the bracket 230 and a peripheral region of the microphone assembly module 200. The compliant member can be adhesively secured to the bracket 230 with an adhesive tape 234. Referring to the laminated construct shown in FIGS. 2 and 4, for example, the compliant member 232 can urge against a peripheral region of the first major surface 212 of the electrical substrate 208 at a position outward of the microphone transducer 202. The stiffener plate 216 can underlie the substrate 208 on a second major surface 214 on a side opposite the major surface 212 against which the compliant member 232 urges.

The bracket 230 can be mounted to the chassis 10 of the electronic device, such that the microphone module and the port module are securely and immovably retained relative to the chassis. For example, the bracket 230 can have a cantilevered mounting region 235 and one or more fasteners 236 can extend through the mounting region and matingly engage with the chassis, as depicted schematically in FIG. 4.

With such an assembly, a liquid 5 in which the electronic device is immersed may enter the port module 100 through the port 11 in the chassis wall. However, the sealing engagement between the duct housing 104 and the chassis wall 10 can inhibit the liquid from by-passing the duct housing. As well, the liquid-resistant port membrane 110 can inhibit liquid from penetrating through the acoustic port 108 in the cap 102, and the compressed gasket member 128 can inhibit liquid from, e.g., seeping through the adhesive bond between the cap 102 and the duct housing 104. Accordingly, an assembly as described above can inhibit entry of liquid to regions of the electronic device that may be susceptible to damage from liquid intrusion.

As may be needed or appropriate, one or more members in the microphone assembly 400 can be electrically grounded with the chassis of the electronic device. For example, an electrically conductive tape can be electrically coupled to a grounding region on one or more of the microphone transducer, the stiffener plate, the electrical substrate, and the port module. The electrically conductive tape can electrically couple the respective grounding region with a grounding region of the chassis, or another selected common ground for the electronic device.

IV. Other Exemplary Embodiments

The examples described above generally concern liquid-resistant electronic devices, electro-acoustic transducers, and modules, as well as related systems. The previous description is provided to enable a person skilled in the art to make or use the disclosed principles. Embodiments other than those described above in detail are contemplated based on the principles disclosed herein, together with any attendant changes in configurations of the respective apparatus or changes in order of method acts described herein, without departing from the spirit or scope of this disclosure. Various modifications to the examples described herein will be readily apparent to those skilled in the art.

For example, although the laminated assemblies shown in FIGS. 1 through 4 are shown and described in relation to circular and annular structures, the laminated assemblies are not so limited in shape. FIGS. 5 through 8 show several plan elevation views of alternative port-modules having differently shaped ports 60, 80, outer peripheries 50, 70, and acoustic ports. For example, disclosed assemblies can have an elongated or an irregular outer periphery shape, such as, for example, an oblong shape, a rectangular shape, etc. Similarly, a cross-sectional shape of disclosed acoustic channels and acoustic ports need not be limited to circular shapes. Rather, any suitable shape (e.g., an elongated or irregular shape) may be used. And, neither the port-module nor the microphone module need be axi-symmetric. Similarly, an outer periphery of a module can have a similar or a different shape as compared to an acoustic duct or channel through the module. Stated differently, disclosed acoustic ducts, ports, vents and channels need not be coaxially arranged or concentric with the corresponding module through which they extend. Accordingly, disclosed acoustic ducts, ports, vents, and channels can be positioned off-center relative to the module of which they are part.

And, a cap having a gas-permeable and water-resistant region need not have a perforation or other aperture laminated with a port membrane, as generally described above. Rather the cap can be perforated as described above. A suitable process can be used to distribute, apply, deposit, adhere, or otherwise attach a porous, gas-permeable and liquid-resistant membrane to the perforated area. For example, polymerized fibers can be deposited directly to the perforated support structure using an electrospinning process. As but one particular example, electrospinning can deposit PVDF fibers to a skeletal structure. Electrospinning and other deposition processes can eliminate the need for laminated, adhesive bonds as described above, while still providing a cap with a gas-permeable and liquid-resistant ported region.

As noted above, port membranes described above span across the acoustic port 108 defined by the cap 102. However, a port membrane as described herein can span across one or more through-hole apertures or perforated regions defined by an electrical substrate, a stiffener plate, or a microphone transducer. Such an alternative placement of the port membrane may be in lieu of, or in addition to, spanning across the acoustic port in the cap.

Directions and other relative references (e.g., up, down, top, bottom, left, right, rearward, forward, etc.) may be used to facilitate discussion of the drawings and principles herein, but are not intended to be limiting. For example, certain terms may be used such as "up," "down,", "upper," "lower," "horizontal," "vertical," "left," "right," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" or "or", as well as "and" and "or." Moreover, all patent and non-patent literature cited herein is hereby incorporated by reference in its entirety for all purposes.

And, those of ordinary skill in the art will appreciate that the exemplary embodiments disclosed herein can be adapted to various configurations and/or uses without departing from the disclosed principles. Applying the principles disclosed herein, it is possible to provide a wide variety of liquid-resistant electronic devices, electro-acoustic transducers, and modules, as well as related systems. For example, the principles described above in connection with any particular example can be combined with the principles described in connection with another example described herein. Thus, all structural and functional equivalents to the features and method acts of the various embodiments described throughout the disclosure that are known or later come to be known to those of ordinary skill in the art are intended to be encompassed by the principles described and the features and acts claimed herein. Accordingly, neither the claims nor this detailed description shall be construed in a limiting sense, and following a review of this disclosure, those of ordinary skill in the art will appreciate the wide variety of liquid-resistant electronic devices, electro-acoustic transducers, and modules, as well as related systems, that can be devised under disclosed and claimed concepts.

Moreover, nothing disclosed herein is intended to be dedicated to the public regardless of whether such disclosure is explicitly recited in the claims. To aid the Patent Office and any readers of any patent issued on this application in interpreting the claims appended hereto or otherwise presented throughout prosecution of this or any continuing patent application, applicants wish to note that they do not intend any claimed feature to be construed under or otherwise to invoke the provisions of 35 USC 112(f), unless the phrase "means for" or "step for" is explicitly used in the particular claim.

The appended claims are not intended to be limited to the embodiments shown herein, but are to be accorded the full scope consistent with the language of the claims, wherein reference to a feature in the singular, such as by use of the article "a" or "an" is not intended to mean "one and only one" unless specifically so stated, but rather "one or more".

Thus, in view of the many possible embodiments to which the disclosed principles can be applied, we reserve the right to claim any and all combinations of features and acts described herein, including the right to claim all that comes within the scope and spirit of the foregoing description, as well as the combinations recited, literally and equivalently, in any claims presented anytime throughout prosecution of this application or any application claiming benefit of or priority from this application, and more particularly but not exclusively in the claims appended hereto.

We currently claim:

1. A liquid-resistant port module comprising:

a housing defining an acoustic channel and extending from a first end to an opposed second end, wherein each end has a corresponding aperture open to the acoustic channel;

a cap defining a gas-permeable region and spanning the aperture corresponding to the first end of the housing;

a liquid-resistant port membrane positioned between the acoustic channel and the gas-permeable region of the cap, wherein the port membrane is gas permeable and prevents movement of water across the port membrane for hydrostatic pressure gradients below a threshold hydrostatic pressure gradient across the port membrane.

2. The liquid-resistant port module according to claim 1, wherein the port membrane comprises a membrane formed of one or more of PTFE and ePTFE.

3. The liquid-resistant port module according to claim 1, further comprising a protective barrier spanning across the channel at a position between the port membrane and the second end of the housing.

4. The liquid-resistant port module according to claim 1, wherein the housing defines an interior surface facing the channel and an exterior surface opposite the interior surface, wherein the exterior surface defines a recess extending around the housing at a position adjacent the second end of the housing.

5. The liquid-resistant port module according to claim 4, further comprising a gasket seated in the recess.

6. The liquid-resistant port module according to claim 1, wherein the housing further defines an abutment positioned adjacent the first end of the channel, the module further comprising an adhesive positioned between the cap and the abutment, wherein the adhesive affixes the cap to the abutment.

7. The liquid-resistant port module according to claim 1, wherein the port module further comprises an adhesive positioned between the liquid-resistant port membrane and the cap, wherein the adhesive affixes the liquid-resistant port membrane to the cap.

8. The liquid-resistant port module according to claim 7, wherein the adhesive defines an aperture positioned between the liquid-resistant port membrane and the gas-permeable region of the cap.

9. The liquid-resistant port module according to claim 1, wherein the housing defines a floor recessed from the first end of the housing, wherein the housing further defines an abutment extending around a periphery of the floor and defining the aperture corresponding to the first end of the housing, wherein the cap is adhesively coupled with the abutment, and wherein the port module further comprises liquid-impermeable gasket member positioned in compression between the port membrane and the floor.

10. The liquid-resistant port module according to claim 9, wherein the channel extends through the floor and the liquid-impermeable gasket member defines an aperture coupling the channel with a region of the port membrane overlying the gas-permeable region of the cap.

11. A microphone assembly, comprising:

a microphone module defining a first acoustic port and a periphery extending around the first acoustic port, the microphone module having a packaged microphone transducer with an exposed sensitive region, the microphone module further having an electrical substrate comprising a plurality of electrical conductors and defining a first major surface, an opposed second major surface, and an aperture extending through the electrical substrate from the first major surface to the second major surface, wherein the packaged microphone transducer is electrically coupled with the plurality of electrical conductors and the aperture through the electrical substrate opens to the sensitive region of the packaged microphone transducer; and a liquid-resistant port module comprising a duct extending from a first end to a second end, wherein the port module defines a liquid-resistant port adjacent the first end of the duct and positioned opposite the first acoustic port, wherein the second end of the duct defines a second acoustic port positioned distally of the first end relative to the microphone module, wherein the periphery of the microphone module is adhesively coupled with a corresponding region of the port module.

12. The microphone assembly according to claim 11, wherein the port module further comprises a protective mesh spanning across the duct at a position between the first end and the second end of the duct.

13. The microphone assembly according to claim 11, wherein the microphone module further comprises a stiffener substrate defining a first major surface, an opposed second major surface, and an aperture extending through the stiffener from the first major surface to the second major surface, wherein the aperture through the stiffener substrate is positioned opposite the aperture through the electrical substrate.

14. The microphone assembly according to claim 11, wherein the microphone module and the port module are coupled with each other such that the sensitive region of the microphone transducer is positioned opposite the liquid-resistant port of the port module relative to the electrical substrate and the stiffener substrate.

15. The microphone assembly according to claim 11, wherein the microphone module and the port module are coupled with each other such that the liquid-resistant port of the port module and the sensitive region of the microphone transducer are acoustically coupled with each other.

16. The microphone assembly according to claim 11, wherein the port module comprises:

a plate spanning across the duct and defining a port region;

a liquid-resistant port membrane spanning across the port region and sealably affixed with the plate; and a housing adhesively coupled with the plate at a region outward of the port membrane, wherein the housing defines the second end of the port module and extends distally from a proximal end positioned adjacent the plate to the second end of the port module.

17. The microphone assembly according to claim 16, wherein the proximal end of the housing defines a recessed floor surrounded by a peripheral wall extending proximally of the floor, wherein the peripheral wall and the plate are adhesively coupled with each other, and wherein the port membrane is positioned laterally inwardly of the peripheral wall.

18. The microphone assembly according to claim 17, wherein the port membrane defines a peripheral region positioned laterally outwardly of the port region of the plate, wherein the microphone assembly further comprises gasket compressed between the peripheral region of the port membrane and the recessed floor.

19. An electronic device, comprising:

an electrical substrate having a plurality of electrical conductors;

a packaged microphone transducer electrically coupled with the plurality of electrical conductors, wherein the packaged microphone transducer defines a sensitive transducer region and a microphone port opening to the sensitive transducer region; and a liquid-resistant port module comprising a housing defining an external port and an acoustic pathway open to the microphone port, wherein the liquid-resistant port module further comprises a liquid-resistant membrane spanning across the acoustic pathway.

20. The electronic device of claim 19, wherein the port module further comprises:

a plate spanning across the acoustic pathway defined by the housing and defining a perforated region, wherein the liquid-resistant membrane spans across the perforated region of the plate and is sealably affixed to the plate, wherein the plate is sealably coupled with the housing separately of the liquid-resistant membrane.

* * * * *